US007744271B2

(12) United States Patent
Jansen et al.

(10) Patent No.: US 7,744,271 B2
(45) Date of Patent: Jun. 29, 2010

(54) DOUBLE SIDED TOURBILLON

(75) Inventors: Rob E. A. Jansen, Tramelan (CH); Louis Lagler, Zürich (CH)

(73) Assignee: Watch-U Licence AG (CH)

( * ) Notice: Subject to any disclaimer, the term of this patent is extended or adjusted under 35 U.S.C. 154(b) by 545 days.

(21) Appl. No.: 10/554,904

(22) PCT Filed: Apr. 30, 2004

(86) PCT No.: PCT/CH2004/000265

§ 371 (c)(1),
(2), (4) Date: Sep. 6, 2006

(87) PCT Pub. No.: WO2004/097533

PCT Pub. Date: Nov. 11, 2004

(65) Prior Publication Data

US 2007/0041276 A1 Feb. 22, 2007

(30) Foreign Application Priority Data

May 2, 2003 (CH) ..... 0780/03

(51) Int. Cl.
*G04B 15/00* (2006.01)

(52) U.S. Cl. ..... 368/127; 368/124

(58) Field of Classification Search ..... 368/127, 368/128, 129, 124
See application file for complete search history.

(56) References Cited

U.S. PATENT DOCUMENTS 6,890,094 B2 * 5/2005 Dias ..... 368/127

FOREIGN PATENT DOCUMENTS

| | | | |
|---|---|---|---|
| CH | 691 832 | A5 | 10/2001 |
| EP | 0 727 721 | A1 | 8/1996 |
| EP | 1 276 022 | A2 | 1/2003 |

OTHER PUBLICATIONS

International Search Report PCT/CH2004/000265 dated Oct. 22, 2004.

* cited by examiner

*Primary Examiner*—Vit W Miska
*Assistant Examiner*—Sean Kayes
(74) *Attorney, Agent, or Firm*—Ostrolenk Faber LLP

(57) ABSTRACT

The invention relates to a tourbillon mechanism comprising at least one platform, a balance arranged on the face of the platform(s), an escapement mechanism being arranged on the other face.

7 Claims, 2 Drawing Sheets

DOUBLE SIDED TOURBILLON

CROSS REFERENCE TO RELATED APPLICATION

The present application is a 35 U.S.C. §371 national phase conversion of PCT/CH2004/000265 filed 30 Apr. 2004, which claims priority of Swiss Patent Application 780/03 filed 2 May 2003, which are herein incorporated by reference.

BACKGROUND OF THE INVENTION

The invention relates to a tourbillon, or a tourbillon module, as well as a clockwork with a tourbillon mechanism, according to the preamble of the independent patent claims.

So-called "tourbillon" clockworks are known from the state of the art, with which the balance is arranged on a rotary stand. In contrast to a conventional clockwork, with such a clockwork, a rotational movement about the same balance axis or about a rotation axis parallel to the balance axis is superimposed on the pendulum movement of the balance, with the aim of statistically compensating inaccuracies which are dependent on the position.

Conventional tourbillon designs are classed as flying, semi-flying or conventional. The differences of the individual manners of design are based on the arrangement of the bearings which serve for the mounting of the rotary stand and the balance. A good overview with regard to the different tourbillons may be deduced from the book "Das Tourbillon" by Reinhard Meis, 1993, Callway publishing house, Munich.

With a so-called flying tourbillon design, the balance and the escapement mechanism (as a rule lever escapement) is mounted on the rotary stand. With non-flying or semi-flying tourbillons, the arbor (axle) of the balance (balance arbor), completely or at least on one side, is mounted outside the rotary stand. With all known tourbillon designs, the balance and the escapement mechanism are arranged on the same side of the platform of the rotary stand, which leads to a one-sided concentration of weight, having a certain negative influence on the clockwork accuracy of the watch/clock. A further disadvantage lies in the fact that due to the construction manner which is often convoluted, the assembly and the maintenance of the tourbillon are difficult to accomplish. In particular with flying tourbillons, the balance arbor has a limited length, which has a negative effect on the loading of the bearings.

SUMMARY OF THE INVENTION

It is the object of the invention to specify a tourbillon or tourbillon module which has an improved balancing.

The tourbillon according to the invention, in contrast to the state of the art of known devices, has a double-sided construction.

With a preferred embodiment, a central main bearing which serves for mounting the complete rotary stand or the rotary stands or platforms, is arranged in the vertical direction (with respect to the longitudinal direction of the balance arbor) between the balance and the escapement in a sandwich-like manner. With regard to the main bearing of the tourbillon, it is preferably the case of a ball bearing or sliding bearing. By way of this arrangement, there exists the possibility of realising an optimally equilibrated mass compensation of the rotating parts of the tourbillon.

With this embodiment, the main bearing, in the inside, comprises a sleeve-like main arbor with a continuous opening, which forms an integral component of the bearing, or is designed as a separate part. The main arbor connects two platforms (rotary stands) lying opposite with respect to the central main bearing, to one another. A balance consisting of a balance wheel and a balance spring, is arranged on the one platform, and an escapement mechanism is arranged on the oppositely lying platform. The balance and the escapement mechanism are actively connected to one another via a balance arbor which runs in the inside of the main bearing. The balance arbor is preferably mounted by way of two balance bearings lying opposite one another, which are held by way of bridge designs arranged on the two oppositely lying platforms. As a result of the double-sided construction of the tourbillon mechanism, the possibility exists of optimally equilibrating the entire arrangement with respect to the main bearing. Preferably at least one of the platforms comprises an external tooth system which serves for coupling to a train of a clockwork. The described design of a tourbillon according to the invention permits a modular, double-sided flying construction.

In a preferred embodiment, the complete tourbillon mechanism is grouped together in a module which may be separated from the rest of the clockwork in a simple way and manner. As a module, there exists the possibility of arranging the tourbillon in the clockwork such that it may be separated from this in a freely detachable manner without previously having to disassemble a multitude of components of the watch/clock. There likewise exists the advantage that the module is constructed separate to the clockwork, and on assembly of the watch/clock it may be applied into this only at the end. Required tests and adjustments may thus be carried out in an independent manner.

A further embodiment comprises only one platform on whose one side the balance with the balance spring are arranged, and on the other side the escapement mechanism is arranged. The central platform comprises an opening through which the balance arbor runs. A bridge design is arranged on each side of the platform, and serves for mounting the oppositely lying balance bearing. The balance bearings are either arranged centrically or eccentrically with respect to the platform. With an eccentric arrangement, an additional circular movement is superimposed on the balance. Preferably, the platform comprises an external tooth system which serves for coupling to a train of a clockwork. Another active connection is possible. Instead of a central main bearing, this embodiment comprises two oppositely lying main bearings which are preferably actively connected to the bridge designs and are essentially arranged at the height of the balance bearings. With certain embodiments, a coaxial arrangement of the balance and of the two main bearings is preferred. Whilst, accepting a one-sided mass distribution, there exists the possibility of a one-sided mounting with only one bearing.

With the described embodiments, the balance arbors comprise a maximised length since they extend over the complete height of the tourbillon. This has a positive effect on the loading of the balance bearing since the reaction forces arising as a result of the occurring moments are comparatively smaller. There exists the possibility of dimensioning these smaller by way of this.

The double-sided tourbillon according to the invention allows a watch/clock with a double-sided tourbillon or one which flies on both sides to be constructed, which displays to the balance on the side of the watch face and the escapement on the side lying opposite the watch face.

This design additionally offers the advantage that all essential parts of the tourbillon, in particular escapement, balance, balance spring and balance adjustment mechanism as well as the main bearing and balance bearing are freely accessible for control, maintenance and adjustment.

With a construction having two platforms, preferably at least one of the platforms is detachably connected to the main arbor. With this, there exists the possibility of a simple assembly and maintenance of the tourbillon or the main bearing.

With a further embodiment with two platforms, the balance bearings are integrated in the sleeve-like main arbor. This offers the possibility of doing away with the outer-lying bridge designs, so that the view to the balance and the escapement mechanism are even better.

With a further embodiment with two-platforms, at least one of the balance bearings is stationary, i.e. not rotating with a base of the tourbillon or actively connected to the clockwork. Although the view to the components is compromised by way of this, this embodiment comprises a balance arbor with a maximal length.

BRIEF DESCRIPTION OF THE DRAWINGS

One embodiment of the invention is described in more detail by way of the subsequent figures. There are shown in.

DESCRIPTION OF THE EMBODIMENTS

Figure 1:
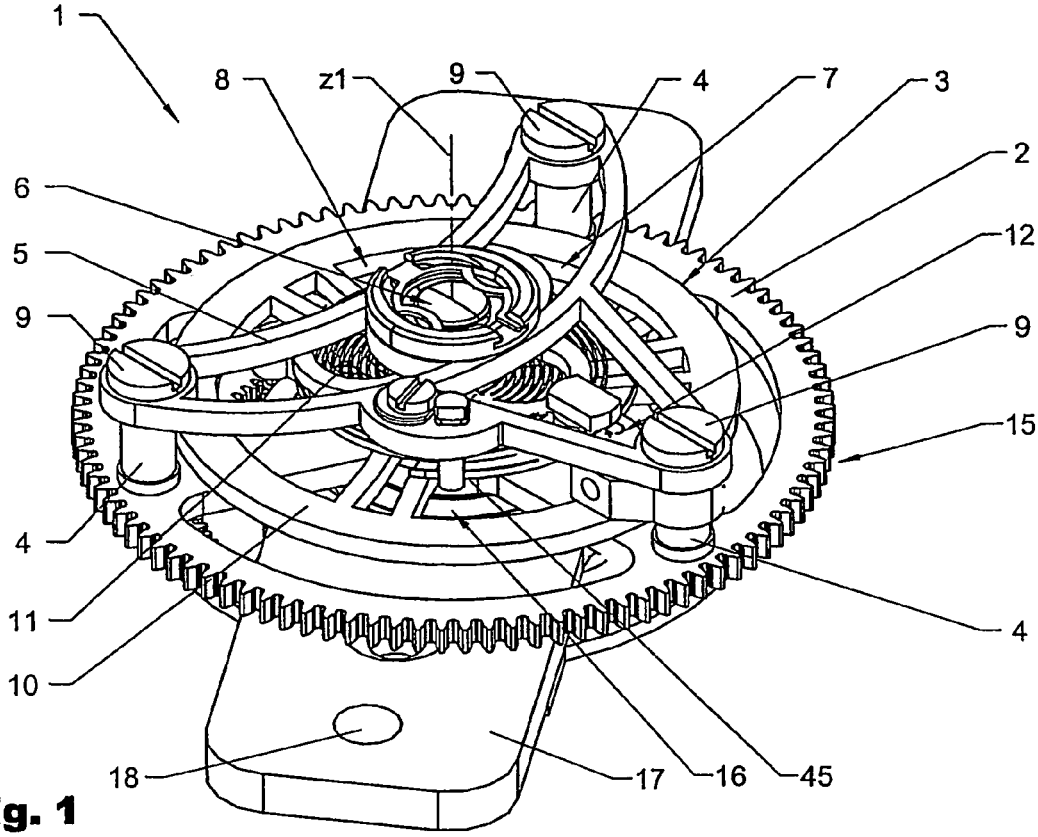
FIG. 1 a perspective view of a double-sided tourbillon mechanism, on the balance side.

FIG. 1 shows a double-sided tourbillon mechanism 1 in a perspective representation seen obliquely from the top. With the shown embodiment, it is the case of a tourbillon mechanism 1 which has a modular construction or is designed as a module, which may be simply separated from a clockwork (not shown in more detail) and reinserted again. For this purpose, the clockwork comprises a preferably continuous opening in the plate which corresponds to the outer dimensions of the tourbillon mechanism 1, in particular to the diameter of the larger platforms 2. Of course the tourbillon mechanism when required may also be fixedly installed into a clockwork, but this renders the assembly and the construction much more difficult.

One may recognise a first platform 2 on which three props 4 are arranged, on which a first balance bearing mount 5 is fastened by way of three screws 9. A first balance bearing 6 is arranged in the middle of the balance bearing mount 5 and serves for the mounting of the one end of the balance arbor 7 (cf. FIG. 3). The props 4 and the balance bearing mount 5 together form a first balance bearing bridge 8. A balance 3 with a balance wheel 10 and with a balance spring 11, is arranged on the balance bearing arbor 7. An inner end 45 (cf. FIG. 3) of the balance spring 11 is actively connected to the balance 3. An outer end 46 of the balance spring 11 is actively connected to the balance bearing bridge 8 in the region of a fastening point 13. A balance adjusting mechanism 12 serves for adjusting the balance spring 11 or the balance 3.

The first platform 2 comprises an outer tooth system 15 which in the installed condition of the tourbillon module 1 meshes with a train of a clockwork (both not shown in more detail). The tourbillon mechanism 1 is driven by the outer tooth system 15, or the clockwork train of the watch is subjected to escapement. Other or alternative active connections to a clockwork are possible.

The first and the second platform 2, 20 as well as the parts of the tourbillon mechanism 1 which are fastened/mounted thereon are rotatably arranged about a first rotation axis (main rotation axis) z1 via a main bearing 16 (cf. FIG. 3) which is fastened on a base 17. The base 17 comprises fastening means, here in the shape of openings 18, which serve for fastening the tourbillon mechanism 1, or the tourbillon module in a clockwork (not shown in more detail).

Figure 2:
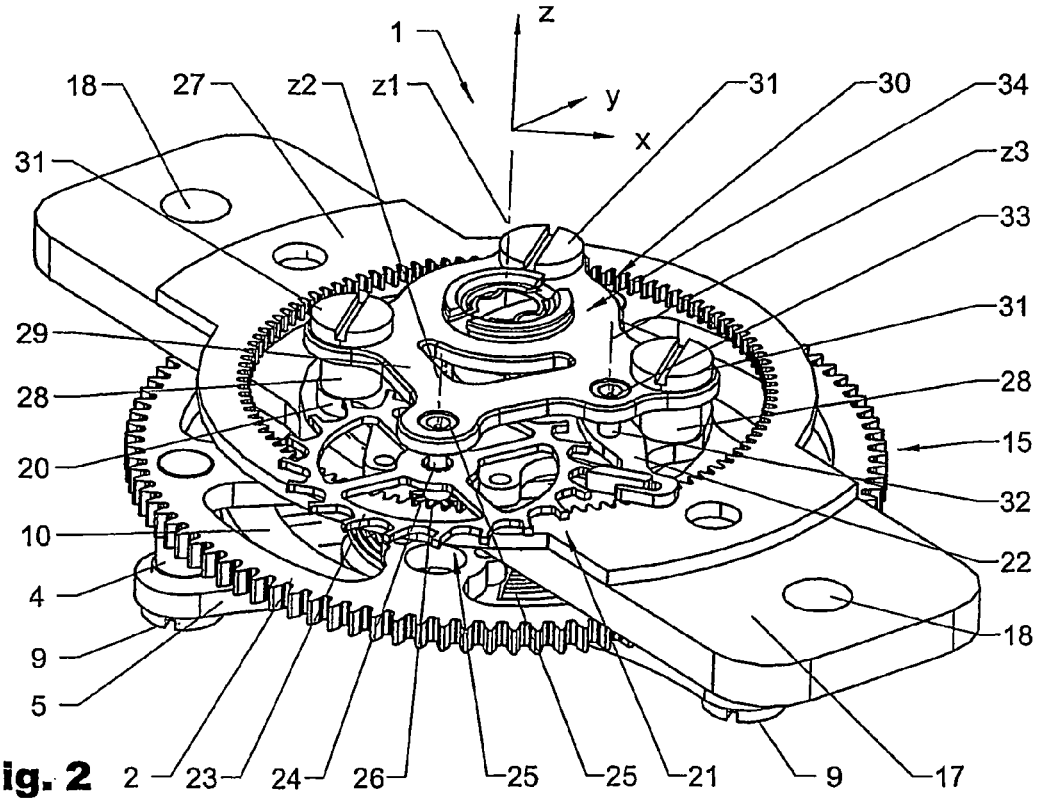
FIG. 2 a perspective view of the double-sided tourbillon mechanism according to FIG. 1, on the escapement side.

FIG. 2 shows the tourbillon mechanism 1 of FIG. 1 from the lower side. An escapement mechanism 21 is arranged on a second platform 20. An escape 22 is in active connection with an escape wheel 23. The escape wheel 23 is arranged on an escape wheel shaft 24 which is rotatably mounted in two escape bearings 25. The escape wheel bearings 25 are directly or indirectly fastened on the second platform 20, so that the escape wheel shaft 24 is arranged rotatable about a rotation axis z2 with respect to the second platform 20. An escape pinion 26 is seated on the escape wheel shaft 24 and is in engagement with a stationary cog-27, here toothed on the inside, which is assembled on the base 17. The escape 22 is fastened on an escape shaft 32 which is rotatably arranged about a third rotation axis z3 in two escape bearings 33. The escape 22 on its inner end which is aligned towards the balance bearing arbor 7 comprises a groove into which a pivot (pin) which is fastened on the balance bearing arbor 7 (both not visible) and is aligned in the z-direction engages. On account of this active connection, the pendulum movement of the balance is transmitted onto the escape 22 and via this onto the escape wheel 23, or the balance is driven (classic lever escapement). In place of the cog 27 toothed on the inside, one may also use a cog toothed on the outside which is actively connected to the base 17, or is integrated into this.

Here three second props 28 are arranged on the second platform 20 which serve for fastening a second balance bearing mount 29 by way of second screws 31. The second props 28 and the balance bearing mount 29 together form a second balance bearing bridge 30. The balance bearing mount 29 here serves for mounting a second balance bearing 34 as well as one of the two escape wheel bearings 25. With the balance bearings 6, 34 it is typically the case of ruby bearings known from the state of the art which serve for the mounting of the balance arbor 7 in the axial (z) and radial direction (x, y). A rotation about the rotation axis z1 is not compromised.

As may be recognised, with the shown embodiment of the invention, it is the case of a tourbillon flying on both sides with which the balance 3 as well as the escapement mechanism 21 are freely accessible. The main bearing 16 is arranged between the two platforms 2, 20 in a sandwich-like manner. With a suitable design of the first and/or the second platform 20, the main bearing 16 at least in certain positions is largely freely accessible so that a maintenance and adjustment are possible.

Figure 3:
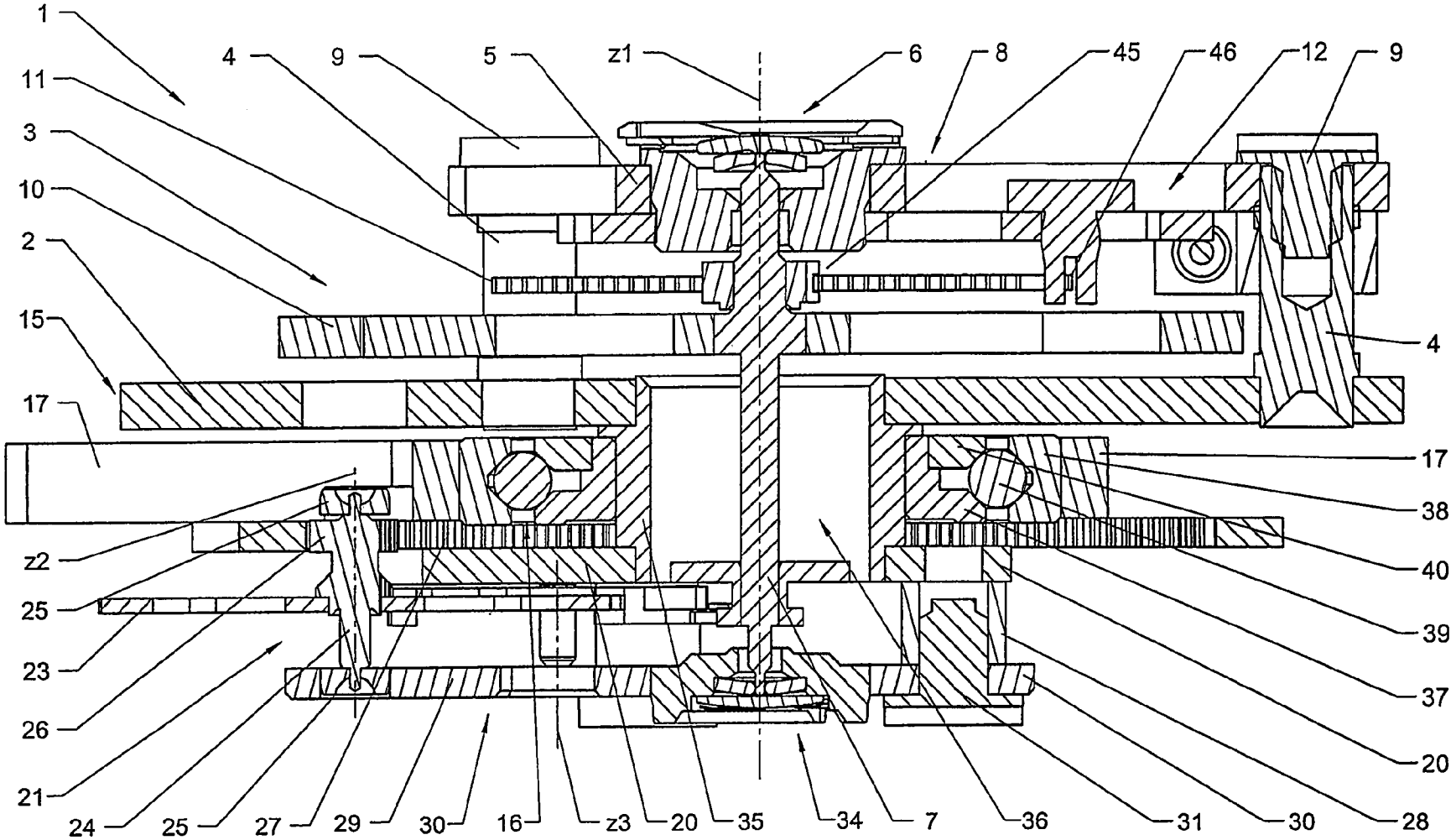
FIG. 3 a section through the double-sided tourbillon mechanism according to FIG. 1 and FIG. 2.

FIG. 3 shows a sectioned representation through the tourbillon mechanism 1 according to the FIGS. 1 and 2. The section is placed such that the two rotation axes z1 and z2 lie in the section plane. The reference numerals correspond to those reference numerals used in the FIGS. 1 and 2. The first and second platform 2, 20 are rigidly connected to one another by a main arbor 35. The main arbor 35 here is designed as a sleeve and comprises a continuous opening 36. The balance arbor 7 is arranged in the inside of the opening 36 and at both ends is rotatably mounted about the axis z1 in a first and in a second balance bearing 6, 34.

The main bearing 16 serves for the rotatable mounting of the main arbor 35. An inner ring 37 of the main bearing 16 is fastened on the main arbor 35. An adjustment ring 40 here serves for setting the bearing play of the main bearing 16. Balls 39 create an active connection between the rotatably arranged inner ring 37 and a stationary outer ring 38 of the main bearing 16. The outer ring 38 is connected to the base 17 of the tourbillon mechanism 1.

Other bearings are suitable with certain embodiments. When required, sliding bearings may be applied as long as the friction does not have a negative effect on the accuracy. Preferably standardised ball bearings are applied. The inner ring 37 of the ball bearing 16 and the main arbor 35 may be designed as one piece if required.

With the described embodiment, the main arbor 35 and the balance bearing arbor are arrange coaxially to the z-axis (rotation axis z1).

The balance wheel 10 is fastened on the balance arbor 7. The balance wheel 10 on the one hand is actively connected to an inner end 45 of the balance spring 11 and on the other hand to the escapement mechanism 21 via the balance arbor 7. An outer end 46 of the balance spring 11 is actively connected to the balance bearing bridge 8 and the balance adjustment mechanism 12 which serves for adjusting the balance spring 11 or the balance 10.

The balance arbor 7 in the region of the second platform 20 is actively connected to the escapement mechanism 21 which comprises an escapement (escape) 22 and an escape wheel 23 fixed on an escape wheel arbor 24. The escape wheel arbor 24 is rotatably mounted about a second axis z2 by way of two escape wheel bearings 25 which are fixedly arranged opposite the second platform 20. The escape pinion 26 is fixed on the escape wheel arbor 24 and meshes with the stationary cog which is toothed on the inside and is arranged coaxially to the axis z. The drive of the tourbillon mechanism 1 is effected by way of the gear of the clockwork (not shown in more detail) via the outer tooth system 15 of the first platform 2. The effect of this is that the two platforms 2, 20 actively connected via the main arbor 35 begin to rotate about the axis z1. This rotational movement is limited by the escape pinion 26 which is engaged with the stationary cog 27 which here is toothed on the inside, or by the balance 3 which is in active connection via the escapement mechanism 21.

It is obvious to the man skilled in the art that further embodiments result from a combination of the described embodiments of the invention.

The invention claimed is:

1. A tourbillon mechanism with a rotary stand carrying a balance and an escapement mechanism actively connected to each other, the tourbillon having a sleeve-like main arbor rigid with a main bearing operable to rotatably mount the rotary stand with respect to a base about a first rotation axis, the balance being arranged on one side of the main bearing and the escapement mechanism arranged on an opposite side of the main bearing.

2. A tourbillon mechanism according to claim 1, wherein the rotary stand comprises a first platform on the one side of the main bearing and a second platform arranged on the opposite side of the main bearing, the platforms comprising respective openings through which a balance arbor runs, which actively connects the balance and the escapement mechanism to one another.

3. A tourbillon mechanism according to claim 2, wherein a balance bearing is arranged on a side of each platform, said respective balance bearings operable for mounting the balance arbor about the first rotation axis.

4. A tourbillon mechanism according to claim 2, wherein a platform comprises an outer tooth system which serves for engagement into a train of a clockwork.

5. A tourbillon mechanism according to patent claim 1, wherein the main bearing is a ball bearing or a sliding bearing.

6. A tourbillon mechanism according to claim 1, wherein the tourbillon mechanism is designed as a tourbillon module which is releasable from a clockwork.

7. A clockwork with a tourbillon mechanism according to claim 1, wherein the balance is arranged on the front side of the clockwork, and the escapement mechanism of the rear side of the clockwork.

* * * * *